US007229365B2

(12) United States Patent
Berry

(10) Patent No.: US 7,229,365 B2
(45) Date of Patent: Jun. 12, 2007

(54) GOLF ASSISTANCE DEVICE

(76) Inventor: Martin Berry, 3737 San Dimas, Suite 101, Bakersfield, CA (US) 93301

( * ) Notice: Subject to any disclaimer, the term of this patent is extended or adjusted under 35 U.S.C. 154(b) by 92 days.

(21) Appl. No.: 11/241,485

(22) Filed: Sep. 29, 2005

(65) Prior Publication Data

US 2007/0072691 A1 Mar. 29, 2007

(51) Int. Cl.
*A63B 57/00* (2006.01)

(52) U.S. Cl. ..... 473/386; 294/19.2

(58) Field of Classification Search ..... 473/386, 473/286; 294/19.2

See application file for complete search history.

(56) References Cited

U.S. PATENT DOCUMENTS

| | | | | |
|---|---|---|---|---|
| 2,609,198 | A | 9/1952 | Armstrong | |
| 2,943,856 | A | 7/1960 | Eimerman | |
| 3,669,427 | A | 6/1972 | Curtis | |
| 3,904,200 | A | 9/1975 | Jackle et al. | |
| 4,013,295 | A | 3/1977 | Baughman | |
| 4,589,661 | A | 5/1986 | Attig | |
| 4,616,826 | A | 10/1986 | Trefts | |
| 4,714,250 | A | 12/1987 | Henthorn | |
| 4,819,938 | A | 4/1989 | Hill | |
| 4,949,961 | A | 8/1990 | Milano | |
| 4,951,947 | A | 8/1990 | Kopfle | |
| 4,969,646 | A | 11/1990 | Tobias | |
| 5,080,357 | A | 1/1992 | Wolf | |
| 5,165,744 | A | 11/1992 | Vogrin | |
| 5,310,177 | A | 5/1994 | Conrad et al. | |
| 5,330,177 | A | 7/1994 | Rogge | |
| 5,503,394 | A | 4/1996 | Mauck et al. | |
| 5,669,646 | A | 9/1997 | Fiocca et al. | |
| 5,672,121 | A | 9/1997 | Miller | |
| 5,707,303 | A | 1/1998 | Berkowitz et al. | |
| 6,254,497 | B1 * | 7/2001 | Brant et al. | 473/386 |
| 6,338,685 | B1 | 1/2002 | Posluszny | |
| 6,394,515 | B1 | 5/2002 | Keleher et al. | |
| 6,672,977 | B1 | 1/2004 | Colbo et al. | |
| 6,887,169 | B2 * | 5/2005 | Whitehill et al. | 473/386 |
| 7,175,547 | B2 * | 2/2007 | Naus, Jr. | 473/386 |

* cited by examiner

*Primary Examiner*—Steven Wong
(74) *Attorney, Agent, or Firm*—Klein, DeNatale, Goldner; James M. Duncan

(57) ABSTRACT

A golf assistance device for placing a golf ball, the device having different embodiments. One embodiment may be used to place a golf ball and tee while another embodiment of the device may be used to pick up and/or place a golf ball on the ground without a tee. Another embodiment of the device may be adjusted such that the ball and tee are set a desired height. The legs of the device may be locked such that the device may be left unattended in a standing position. However, when inverted, the legs may collapse against the handle of the device to facilitate storing the device in a golf bag.

23 Claims, 9 Drawing Sheets

GOLF ASSISTANCE DEVICE

BACKGROUND OF THE INVENTION

The present invention generally relates to the game of golf and more particularly to a device which allows a golfer to place and/or retrieve a golf ball without having to bend over. In addition, a ball and tee may be placed within the device and set at a desired height for the golfer to drive the ball.

Various devices are known for picking up or placing golf balls, allowing a golfer to enjoy a round of golf without excessive bending over. Some devices also claim to be able to place a golf ball in combination with a tee so the golfer may drive the ball. In teeing up a ball, the tee must be set nearly perpendicular to the ground surface in order for the ball to remain balanced in the cup of the tee. In addition, the ground penetrating tip of the tee must be implanted at sufficient depth as to allow the tee to support the weight of the ball. A device which places a ball in combination with a tee should be able to reliably accomplish these two functions on a consistent basis, consistently setting the ball and tee combination at position in the driving box which allows the golfer to properly drive the ball. It would also be desirable for such a device to be adaptable for the golfer to use both long tees and short tees.

The known devices have various disadvantages, such as being too large for convenient transportation and storage, too complicated, or simply unable to properly function. Other devices, because they do not remain in an upright position, defeat the purpose of the device because the user may have to bend over to pick up the device itself.

SUMMARY OF THE INVENTION

The present invention is directed to a golf assistance device which responds to the needs identified above. An embodiment of the device may be used to set a golf ball both with and without a tee, at a desired location on the ground without the golfer having to bend over. An embodiment of the device may also be self-standing, such that the golfer may set the device down upon its legs and it will remain standing, thereby eliminating the need for the user to bend over to retrieve the device. As an additional feature, an embodiment of the device comprises legs which, when the device is inverted, the legs collapse along the shaft of the device, making the device capable of being placed within a golf bag without utilizing excessive space by simply turning the device upside down.

An embodiment of the device comprises a mandrel comprising claw attachment receptacles, leg attachment receptacles, an operating rod aperture, and a lock engagement fossa. This embodiment further comprises a sliding member where the sliding member comprises an operating rod connected to a ball engagement member. The operating rod is slideably disposed within the operating rod aperture of the mandrel. The ball engagement member comprises a claw activation member and a downwardly facing ball engagement surface. A lock slidably engages the operating rod, where the lock is adapted to gravitationally slide along the operating rod and be received by the lock engagement fossa. This embodiment further comprises a plurality of legs, with each leg comprising a ground engaging end and an attachment end. Each attachment end is pivotally attached to the mandrel. The attachment ends are adapted to be engaged by the lock when the lock is gravitationally disposed within the lock engagement fossa. This embodiment further comprises at least a pair of claws, each claw comprising a pivot end and a free end, the pivot ends each pivotally attached to the mandrel, the free ends each pivotal from a first position to a second position, the first position comprising the position at which the free ends support the underside of a golf ball, such that the upper surface of the golf ball is disposed against the ball engagement surface, the second position comprising the position at which the free ends withdraw from beneath the golf ball, wherein the claws are pivoted from the first position to the second position by reciprocal motion of the claw activation member. A shaft is connected to the operating rod.

DETAILED DESCRIPTION OF THE EMBODIMENTS

Figure 1:
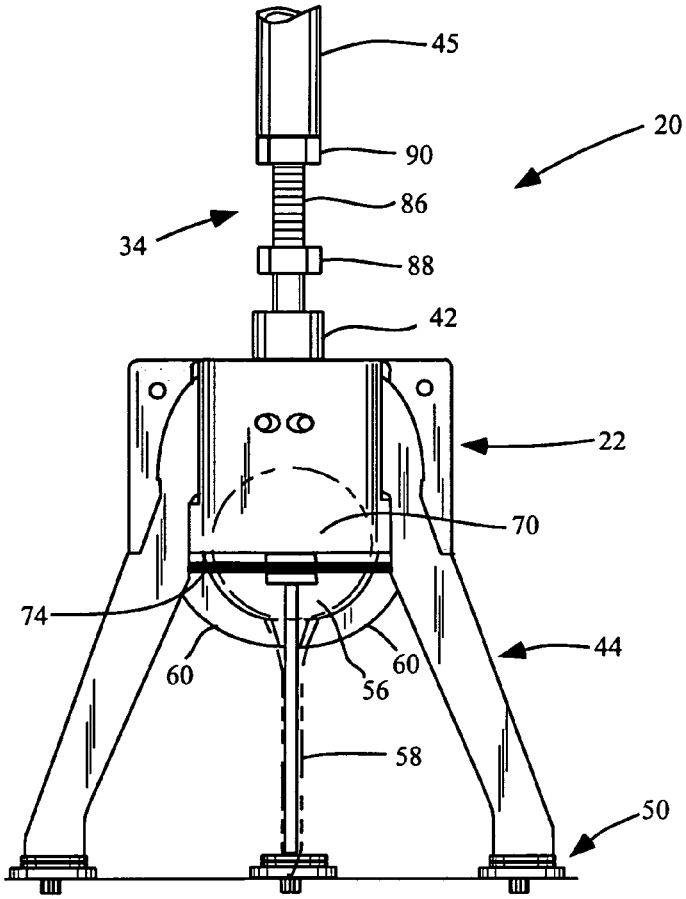
FIG. 1 shows a side view of an embodiment of the disclosed apparatus in which the device is in a standing position and preparing to set a golf ball in combination with a tee.
Figure 2:
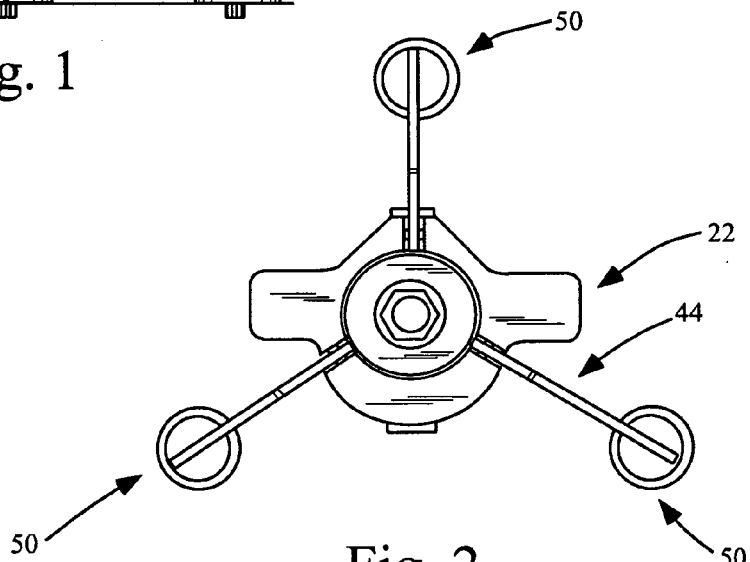
FIG. 2 shows a top view of the disclosed apparatus in which the device is in a standing position.
Figure 3:
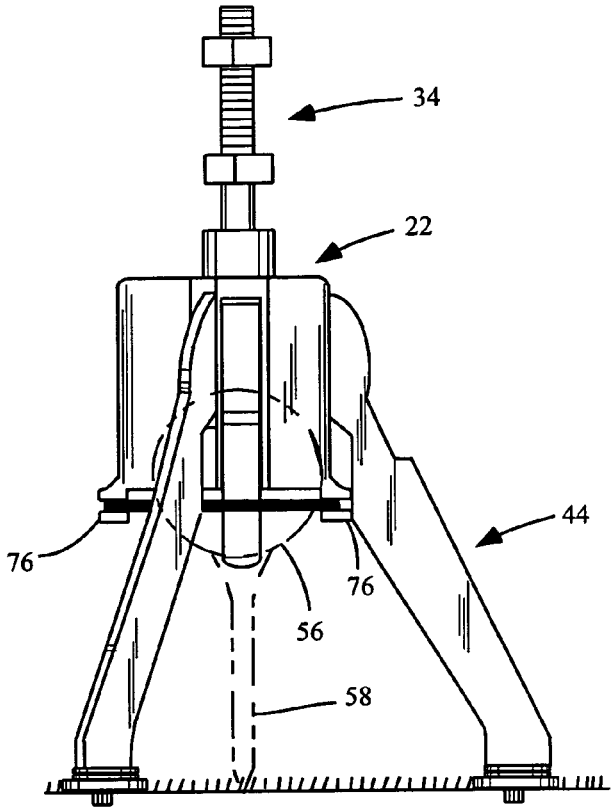
FIG. 3 shows another side view of an embodiment of the disclosed apparatus in which the device is in a standing position and preparing to set a golf ball in combination with a tee.
Figure 4:
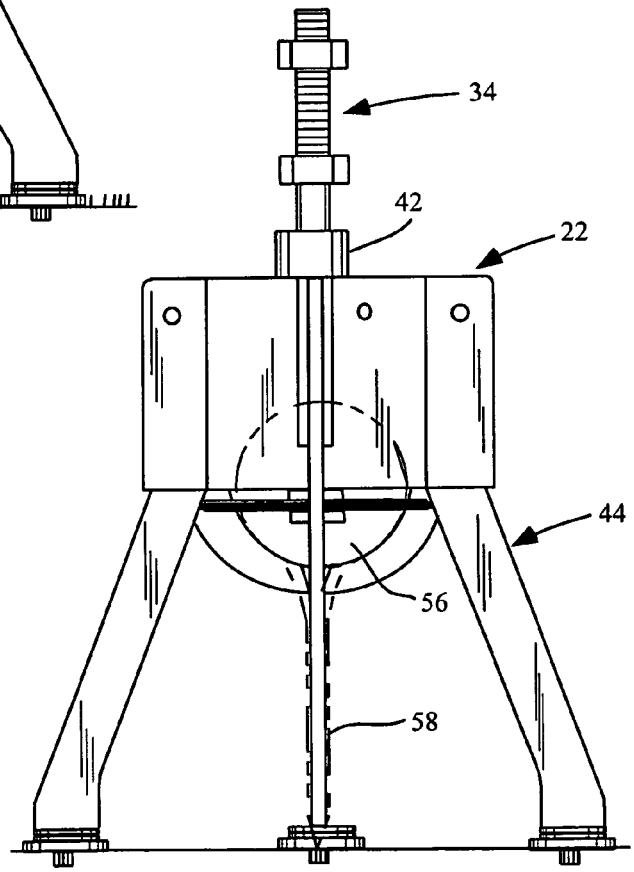
FIG. 4 shows a front view in which the device is in a standing position and preparing to set a golf ball in combination with a tee.
Figure 5:
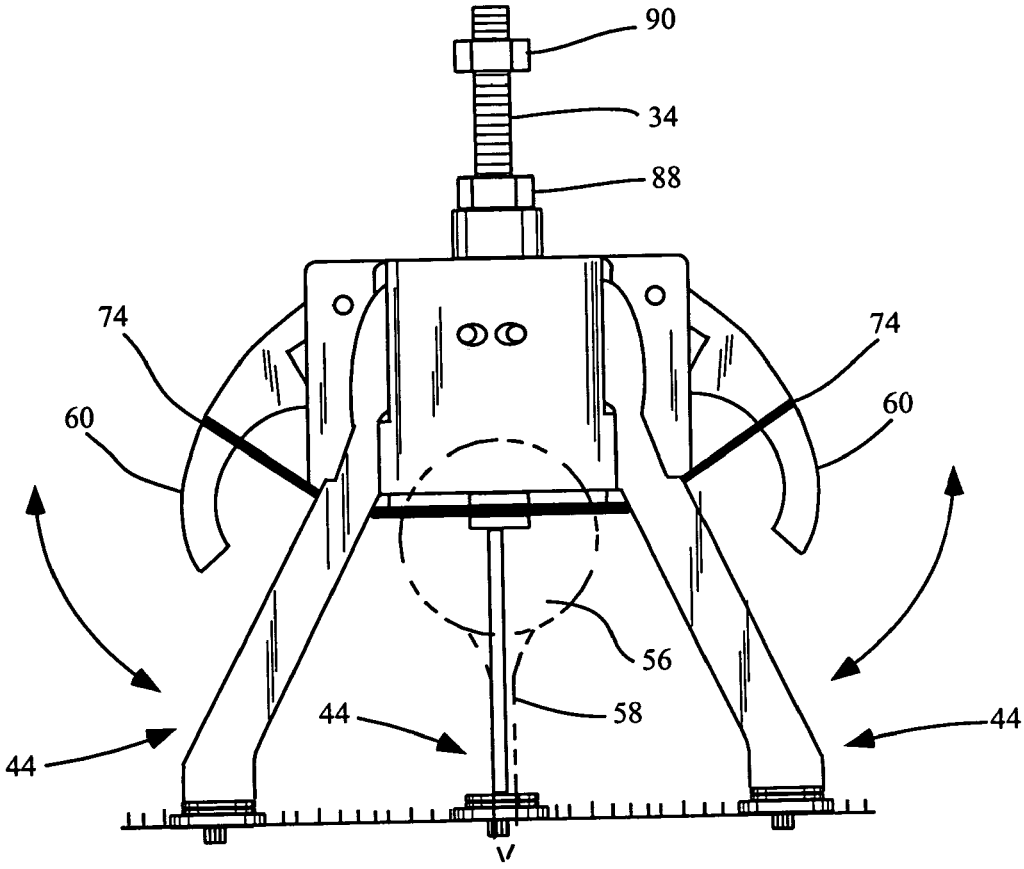
FIG. 5 shows a front view of an embodiment of the disclosed apparatus in which the device has set and released a golf ball in combination with a tee.
Figure 6:
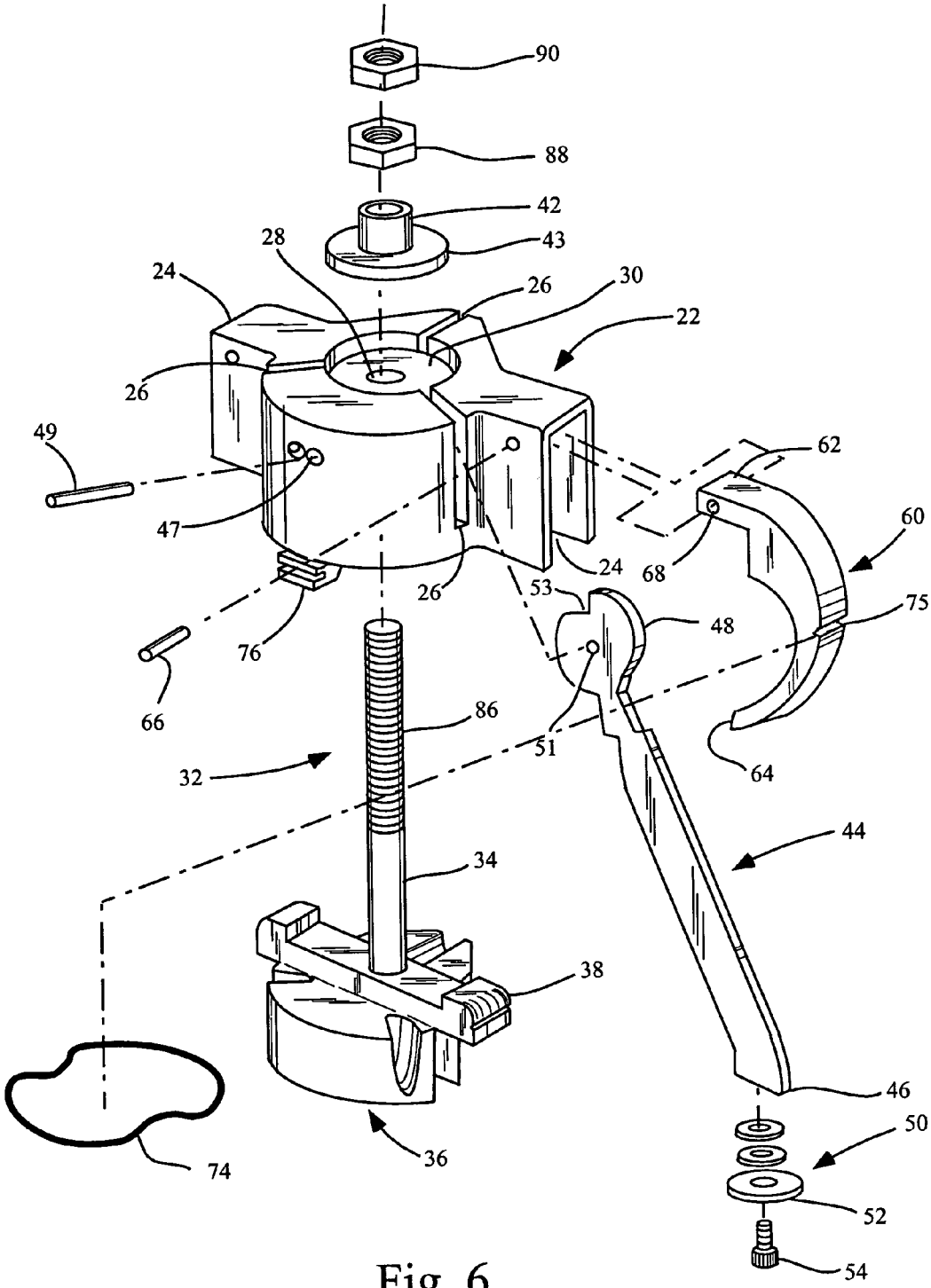
FIG. 6 is an exploded view of an embodiment of the disclosed apparatus.

Referring now specifically to the drawings, FIG. 1 shows a front view of one embodiment device 20. As shown in greater detail in FIG. 6, this embodiment comprises a mandrel 22 comprising claw attachment receptacles 24, leg attachment receptacles 26, an operating rod aperture 28, and a lock engagement fossa 30. The lock engagement fossa 30 is a depression which may be machined or otherwise placed in the top or upper side of the mandrel 22. As shown in FIG. 6, the lock engagement fossa 30 may be generally circular in shape, and the operating rod aperture 28 may be disposed within the center of the lock engagement fossa, such that the fossa is symmetrically disposed about the operating rod aperture This embodiment further comprises a sliding member 32 where the sliding member comprises an operating rod 34 connected to a ball engagement member 36. The operating rod 34 is slideably disposed within the operating rod aperture 28 of the mandrel 22. The ball engagement member 36 comprises a claw activation member 38 and a downwardly facing ball engagement surface 40. A lock 42 slidably engages the operating rod 34, where the lock is adapted to gravitationally slide along the operating rod and be received by the lock engagement fossa 30.

An embodiment of the device further comprises a plurality of legs 44, with each leg comprising a ground engaging end 46 and an attachment end 48. Each attachment end 48 may be pivotally attached within the leg attachment receptacles 26 by the use of attachment means, such as pin 49 inserted within an opening 47 in the mandrel 22 and engaging opening 51 of the attachment end 48. Other attachment means such as rivets, screws, bolts, etc. may also be used to attach legs 44 to the mandrel 22.

The attachment ends 48 are adapted to be engaged by the lock 42 when the lock is gravitationally disposed within the lock engagement fossa 30. As shown in FIG. 6, the attachment ends may have notch 53 such that the edges 43 of lock 42 engage the notch, thereby locking the legs into place. When the device is in a generally vertical position and oriented as shown in FIG. 1 with respect to the ground surface, lock 42 will engage the notches 53 of the attachment ends 48, thereby holding each leg 44 in place. This feature of the device allows the legs of the device to be locked in position such that the device may be left unattended in a standing position.

Figure 8:
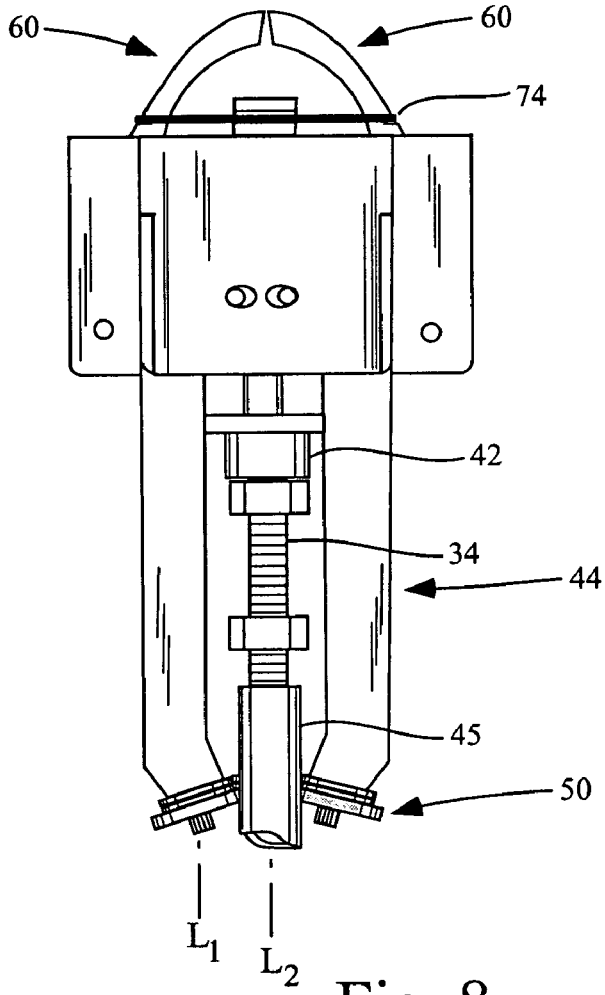
FIG. 8 is a view of an embodiment of the disclosed apparatus in an inverted position, showing how the legs of the device fold toward the center axis of the device.

However, it is to be appreciated that if the device is inverted, gravity will cause lock 42 to disengage from the attachment ends 48, allowing the legs 44 to freely pivot from a first standing position, as shown in FIG. 1, where the lock is in place, to a second position, where the second position is shown in FIG. 8. As shown in FIG. 8, this second position may be defined as the position of a leg 44 when a first axis $L_1$ defined by the leg is generally parallel to a second axis $L_2$ defined by the operating rod 34. This feature allows the device to be easily stored within a golf bag, because once the device is inverted, the lock 42 will disengage, and gravity will cause legs 44 to fall into the second position, where the legs are collapsed against the shaft 45.

Each leg 44 may further comprise foot assembly 50. Foot assembly 50 may comprise one or more ground engaging pads 52, which provide greater stability in variable turf conditions. The foot assemblies 50 further enable an embodiment of the device 20 to maintain a standing position without any support by the user. The length of legs 44 may be adjusted so as to increase the stability of the device. Each foot assembly 50 may further comprise elevation screw 54, which may be adjusted such that the ball 56 may be set higher off of the ground. This feature, i.e., adjusting the height of ball with respect to the ground, allows a user to select either a long tee or a short tee as desired. As an alternative means of changing the height, foot assemblies may be changed out, and extended reach foot assemblies may be installed.

The device further comprises at least a pair of claws 60, each claw comprising a pivot end 62 and a free end 64. The pivot ends are each pivotally attached to the mandrel 22 within the claw attachment receptacles 24. The claws 60 may be pivotally attached within the claw attachment receptacles 24 with pin 66 or with other pivotal attachment means, such as a bolt, screw, rivet or other known means, which may be inserted into opening 68 of the pivot end.

Figure 11:
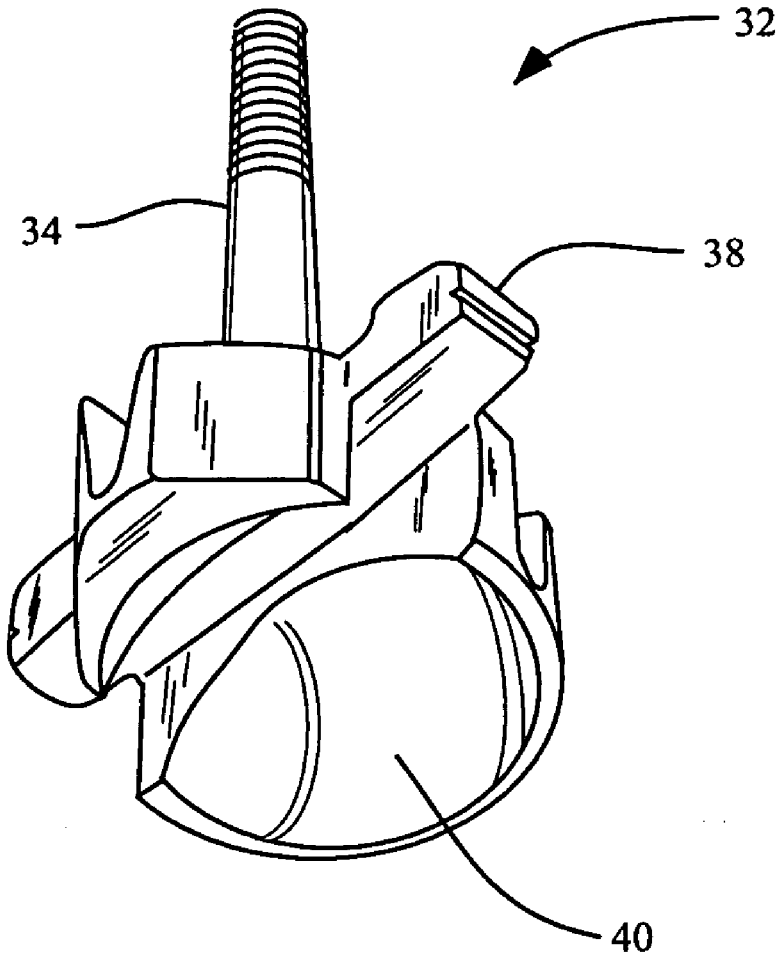
FIG. 11 shows a perspective view of one embodiment of the sliding member.

The free end 64 of each claw 60 is pivotal from a first position to a second position. The first position is shown in FIG. 1, and is defined as the position at which the free ends 64 of the claws 60 come together and support the underside of a golf ball 56, such that the upper surface 70 of the golf ball is disposed against the ball engagement surface 40, shown in FIG. 11. The second position comprises the position at which, as described below, the free ends 64 are pushed away from the underside of the golf ball 56, allowing the golf ball to be released from the device.

Figure 7:
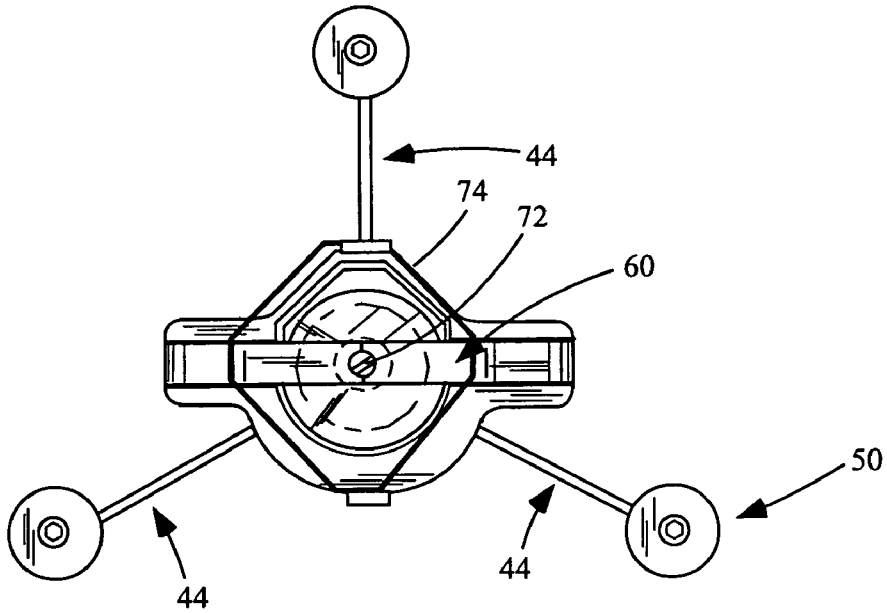
FIG. 7 is a bottom view of an embodiment of the disclosed apparatus.
Figure 10:
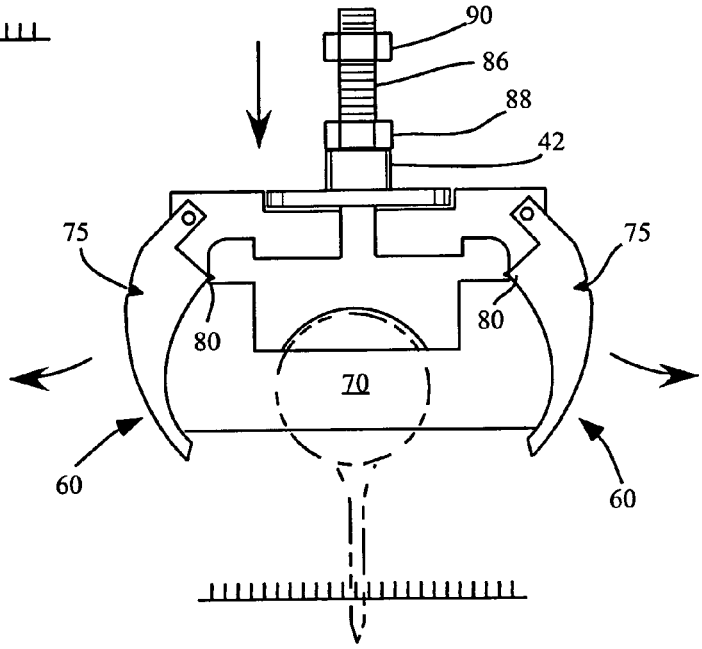

The claws 60 are pivoted from the first position to the second position by reciprocal motion of the sliding member 32 including claw activation member 38. Claws 60 may further comprise tee aperture 72, as shown in FIG. 7. Tee aperture 72 is dimensioned such that the shaft of a tee 58 fits within the aperture when the claws 60 are in the first position. The cup portion of the tee, with a golf ball 56 disposed within it, is retained above the aperture when the claws 60 are in the first position. This feature allows a golfer to use this embodiment to place a ball 56 disposed upon a tee 58 as desired for driving the ball. As shown in FIG. 10, when the claws 60 are pivoted into the second position, the ball 56 and tee 58 may be placed as desired on the ground. It is to be appreciated that while claws 60 are pivoted from the first position to the second position by reciprocation of the claw activation member 38, the pivoting of the claws is further assisted by the underside of the golf ball 56 acting against the free ends 64 of the claws 60.

The claws 60 may be biased in the first position by the use of biasing means, such as an elastic band 74 looping around the outside edge of the claws. The claws 60 may further comprise band retainer notch 75, which provides an engagement surface for the elastic band 74. The mandrel 22 may comprise band retainer stays 76 which provide further means for retaining the elastic band 74. Alternatively, the biasing means may comprise a separate spring attached to each claw 60, to bias the claws in the first position.

Figure 9:
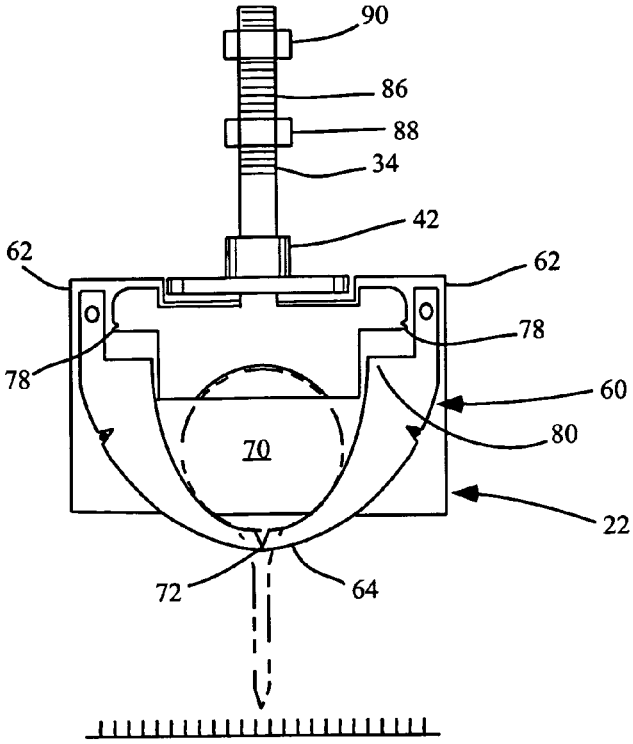
FIGS. 9–10 show how the claws of the device may be activated by reciprocation of the operating rod thereby releasing the ball and the tee.
Figure 12:
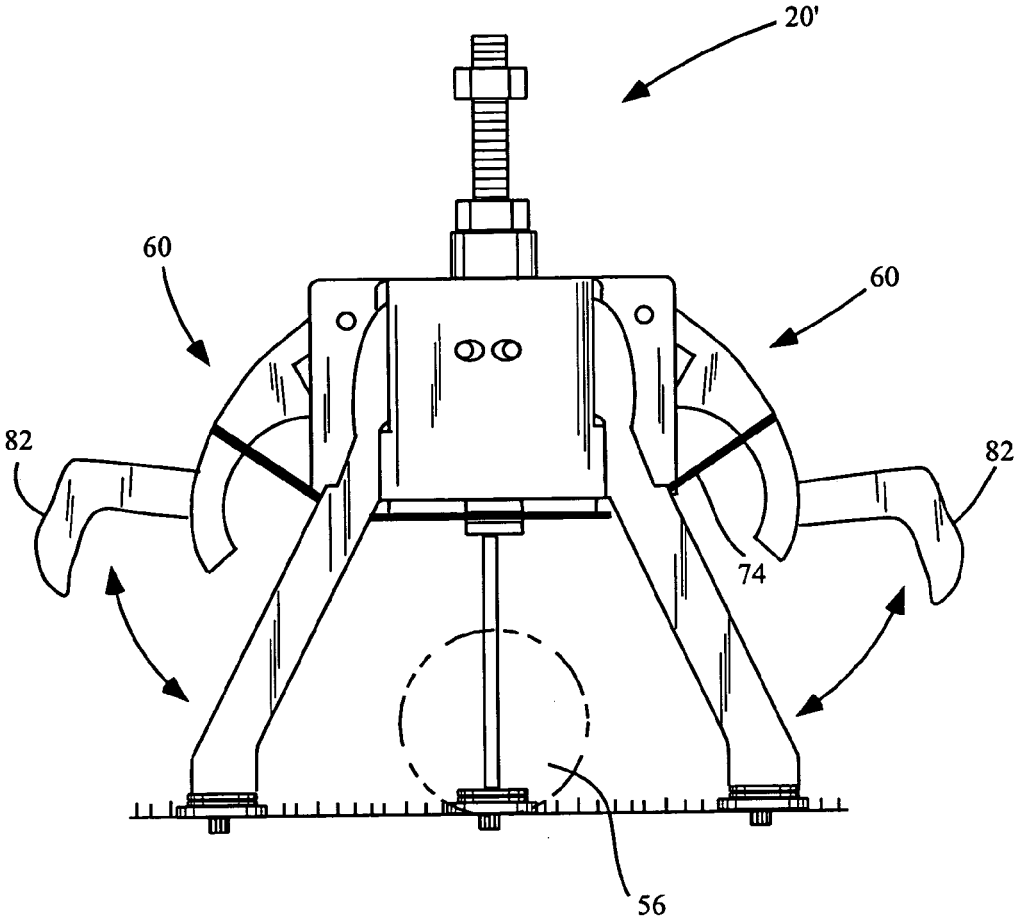
FIG. 12 shows a front view of the disclosed apparatus having ball retrieval members, showing the movement of the ball retrieval members.
Figure 13:
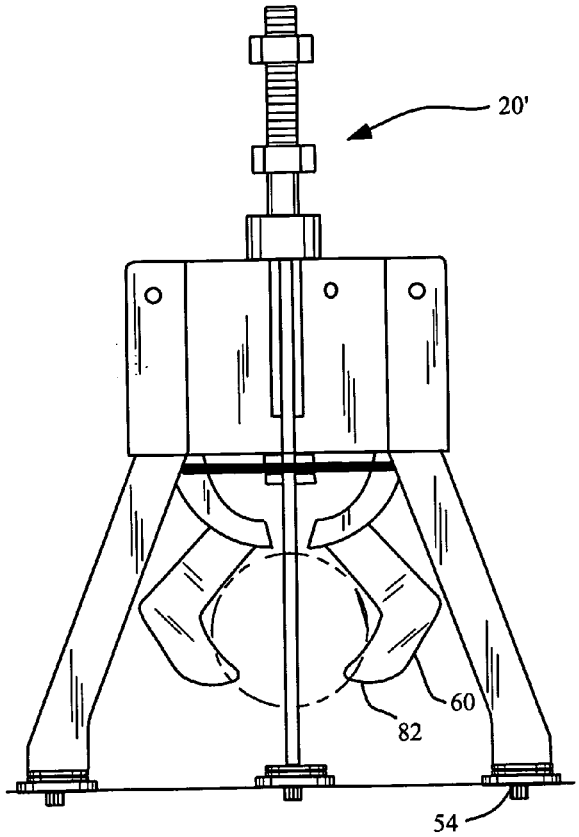
FIG. 13 shows a front view of an embodiment of the embodiment shown in FIG. 12.
Figure 14:
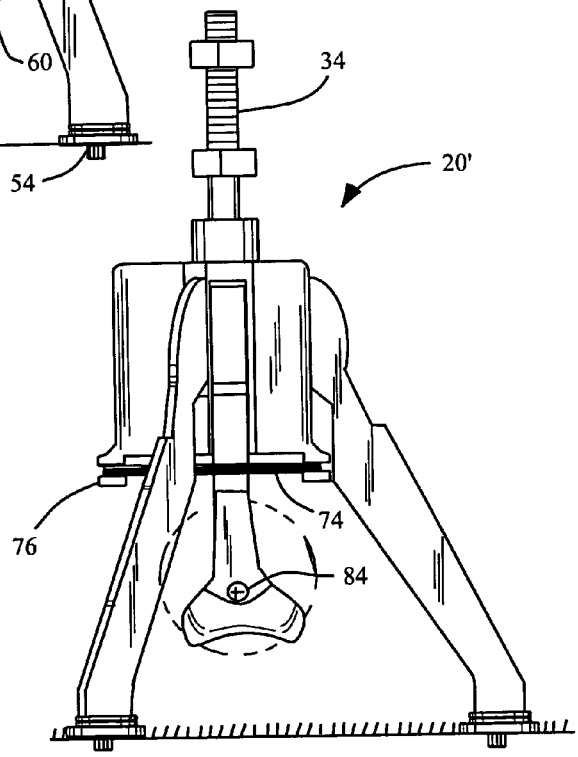
FIG. 14 shows a side view of the embodiment shown in FIG. 12.

One embodiment of the device allows the claws 60 to remain locked in the second position. In this embodiment, claw activation member 38 further comprises a locking notch 78 as shown in FIG. 9. The locking notch 78 engages a comer 80 of claw 60 as shown in FIG. 10. This feature facilitates pulling An embodiment of the device which may be used to retrieve golf balls is shown in FIGS. 12 through 14. This embodiment comprises ball retrieval members 82 attached to each claw 60 with a variety of fastening means, such as screw 84 or other known means such as rivets, pins, bolts, or bonding means such as glue or welding. As shown in FIG. 12, the device 20' may be placed over ball 56. As the retrieval members 82 are pressed against the ball 56, the retrieval members spread apart sufficiently to allow the ball to be engaged as shown in FIG. 13. Once the ball 56 has passed through retrieval members 82, biasing means such as elastic band 74 causes the claws 60 to return to the first position, such that ball retrieval members 82 engage the ball as shown in FIG. 13.

As shown in FIGS. 9 and 10, an embodiment of the device may further comprise means for adjusting the height of a golf ball 56 with respect to the grounds as the ball rests upon a tee 58. Depending upon a golfer's preference, the ball 56 may be set high or low by adjusting how deeply the device sets the tee 58 into the ground. Operating rod 34 may comprise threads 86, upon which first adjustment nut 88 is disposed. As shown in FIG. 10, adjustment nut 88 adjusts the length of travel of operating rod 34 with respect to mandrel 22. As adjustment nut 88 engages the top of lock 42 and mandrel 22, the downward motion of sliding member 32 is stopped, thereby limiting the penetration of tee 58 into the ground. Second adjustment nut 90 may be used to adjust the make-up of shaft 45 onto the operating rod 34, thereby making the overall length of the device adjustable.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following claims.

What is claimed is:

1. A golf assistance device comprising:

a mandrel comprising claw attachment receptacles, leg attachment receptacles, an operating rod aperture, and a lock engagement fossa;

a sliding member comprising an operating rod connected to a ball engagement member, the operating rod slideably disposed within the operating rod aperture, the ball engagement member comprising a claw activation member and a downwardly facing ball engagement surface;

a lock slidably engaging the operating rod, the lock adapted to gravitationally slide along the operating rod and be received by the lock engagement fossa;

a plurality of legs, each leg comprising a ground engaging end and an attachment end, each attachment end pivotally attached to the mandrel, each attachment end adapted to be engaged by the lock when the lock is gravitationally disposed within the lock engagement fossa;

at least two claws, each claw comprising a pivot end and a free end, the pivot ends each pivotally attached to the mandrel, the free ends each pivotal from a first position to a second position, the first position comprising the position at which the free ends support a golf ball disposed against the ball engagement surface, the second position comprising the position at which the free ends withdraw from beneath the golf ball, wherein the claws are pivoted from the first position to the second position by reciprocal motion of the claw activation member; and a shaft connected to the operating rod.

2. The golf assistance device of claim 1 wherein the claws support a golf ball disposed upon a golf tee when the claws are in the first position.

3. The golf assistance device of claim 1 further comprising biasing means for maintaining the claws in the first position, until a reciprocal motion is applied to the claw activation member.

4. The golf assistance device of claim 3 wherein the mandrel comprises band retainer stays and the biasing means comprises an elastic band looping around the band retainer stays and around the outside edge of the claws.

5. The golf assistance device of claim 1 wherein the legs maintain the device in a first standing position when the attachment ends are engaged by the lock.

6. The golf assistance device of claim 5 wherein each leg is pivotable over a range defined by the position of a leg in the first standing position to a second position when the attachment end is not engaged by the lock, where the second position is defined as the position of a leg when a first axis defined by the leg is generally parallel to a second axis defined by the operating rod.

7. The golf assistance device of claim 1 further comprising a ball retrieval member attached to each claw.

8. The golf assistance device of claim 1 wherein a portion of the length of the operating rod above the operating rod aperture is threaded.

9. The golf assistance device of claim 8 wherein the length of travel of the operating rod with respect to the mandrel is adjustable by adjusting a nut on the threaded portion of the operating rod.

10. A golf assistance device comprising:

a mandrel comprising claw attachment receptacles on each side of the mandrel, leg attachment receptacles, an operating rod aperture extending axially through the mandrel and a lock engagement fossa symmetrically disposed about the operating rod aperture;

a sliding member comprising an operating rod connected to a ball engagement member, the operating rod slideably disposed within the operating rod aperture, the ball engagement member comprising a claw activation member and a downwardly facing ball engagement surface;

a lock having an opening for receiving the operating rod, the lock adapted to gravitationally slide along the operating rod and be received by the lock engagement fossa;

three legs, each leg comprising a ground engaging end and an attachment end, each attachment end pivotally attached within a leg attachment receptacle, each attachment end adapted to be engaged by the lock when the lock is gravitationally disposed within the lock engagement fossa wherein the legs maintain the device in a first standing position when the attachment ends are engaged by the lock;

at least two claws, each claw comprising a pivot end and a free end, the pivot ends each pivotally attached to the mandrel, the free ends each pivotal from a first position to a second position, the first position comprising the position at which the free ends support a golf ball disposed against the ball engagement surface, the second position comprising the position at which the free ends withdraw from beneath the golf ball, wherein the claws are pivoted from the first position to the second position by reciprocal motion of the claw activation member; and a shaft connected to the operating rod.

11. The golf assistance device of claim 10 wherein the claws support a golf ball disposed upon a golf tee when the claws are in the first position.

12. The golf assistance device of claim 10 further comprising biasing means for maintaining the claws in the first position until a reciprocal motion is applied to the claw activation member.

13. The golf assistance device of claim 12 wherein the mandrel comprises band retainer stays and the biasing means comprises an elastic band looping around the band retainer stays and around the outside edge of the claws.

14. The golf assistance device of claim 10 wherein each leg is pivotable over a ranged defined by the first standing position to a second position when the attachment end is not engaged by the lock, where the second position is defined as the position of a leg when a first axis defined by the leg is generally parallel to a second axis defined by the operating rod.

15. The golf assistance device of claim 10 further comprising a ball retrieval member attached to each claw.

16. The golf assistance device of claim 10 wherein a portion of the length of the operating rod above the operating rod guide is threaded.

17. The golf assistance device of claim 16 wherein the length of travel of the operating rod with respect to the leg support mandrel is adjustable by adjusting a nut on the threaded portion of the operating rod.

18. A golf assistance device comprising:

a leg support mandrel comprising claw attachment receptacles on each side of the mandrel, three leg attachment receptacles, an operating rod aperture extending axially through the mandrel and a lock engagement fossa symmetric about the operating rod aperture;

a sliding member comprising an operating rod connected to a ball engagement member, the operating rod slideably disposed within the operating rod aperture, the ball engagement member comprising a claw activation member and a downwardly facing ball engagement surface;

a lock having an opening for receiving the operating rod, the lock adapted to gravitationally slide along the operating rod and be received by the lock engagement fossa;

three legs, each leg comprising a ground engaging end and an attachment end, each attachment end pivotally attached within a leg attachment receptacle, each attachment end adapted to be engaged by the lock when the lock is gravitationally disposed within the lock engagement fossa wherein the legs maintain the device in a first standing position when the attachment ends are engaged by the lock, wherein each leg is pivotable over a ranged defined by the first standing position when the attachment end is engaged by the lock to a second position when the attachments end is not engaged by the lock, where the second position is defined as the position of a leg when a first axis defined by the leg is parallel to a second axis defined by the operating rod;

at least two claws, each claw comprising a pivot end and a free end, the pivot ends each pivotally attached to the leg support mandrel, the free ends each pivotal from a first position to a second position, the first position comprising the position at which the free ends support a golf ball disposed against the ball engagement surface, the second position comprising the position at which the free ends withdraw from beneath the golf ball, wherein the claws are pivoted from the first position to the second position by reciprocal motion of the claw activation member;

biasing means for maintaining the claws in the first position until a reciprocal motion is applied to the claw activation member; and a shaft connected to the operating rod.

19. The golf assistance device of claim 18 wherein the claws support a golf ball disposed upon a golf tee when the claws are in the first position.

20. The golf assistance device of claim 18 further comprising a ball retrieval member attached to each claw.

21. The golf assistance device of claim 18 wherein a portion of the length of the operating rod above the operating rod guide is threaded.

22. The golf assistance device of claim 21 wherein the length of travel of the operating rod with respect to the leg support mandrel is adjustable by adjusting a nut on the threaded portion of the operating rod.

23. The golf assistance device of claim 18 wherein the mandrel comprises band retainer stays and the biasing means comprises an elastic band looping around the band retainer stays and around the outside edge of the claws.

* * * * *